US007168096B1

(12) United States Patent
Landa et al.

(10) Patent No.: US 7,168,096 B1
(45) Date of Patent: Jan. 30, 2007

(54) BIKINI ASSEMBLY

(76) Inventors: Jose S. Landa, 7958 Cadenza La., North Las Vegas, NV (US) 89123; Pamela S. Roybal, 7958 Cadenza La., North Las Vegas, NV (US) 89123

( * ) Notice: Subject to any disclaimer, the term of this patent is extended or adjusted under 35 U.S.C. 154(b) by 430 days.

(21) Appl. No.: 10/773,582

(22) Filed: Feb. 9, 2004

(51) Int. Cl.
*A41D 5/00* (2006.01)

(52) U.S. Cl. ..... 2/67; 2/73; 450/64; 450/86

(58) Field of Classification Search ..... 2/73, 2/67; D2/703, 707, 737, 731; 450/64, 86
See application file for complete search history.

(56) References Cited

U.S. PATENT DOCUMENTS

| | | | | | |
|---|---|---|---|---|---|
| 2,015,589 | A | | 9/1935 | Cahn | |
| 2,104,943 | A | | 1/1938 | D'Achon | |
| D130,974 | S | * | 12/1941 | Laszlo | D2/735 |
| 2,443,474 | A | | 6/1948 | Morgan | |
| 2,453,051 | A | | 11/1948 | Vacca | |
| 2,535,018 | A | * | 12/1950 | Reid | 2/67 |
| 2,542,881 | A | * | 2/1951 | Ries | 450/59 |
| 2,611,130 | A | * | 9/1952 | Engelman | 450/30 |
| 3,306,299 | A | | 2/1967 | Paramore | |
| 3,740,765 | A | * | 6/1973 | Delplace | 2/67 |
| 3,847,158 | A | * | 11/1974 | Guidoni | 450/68 |
| 3,939,845 | A | * | 2/1976 | Guidoni | 450/68 |
| 4,031,900 | A | | 6/1977 | Guidoni | |
| 4,121,305 | A | * | 10/1978 | Kolker | 2/406 |
| 4,656,669 | A | * | 4/1987 | Beard | 2/67 |
| D293,156 | S | | 12/1987 | Dunnagan | |
| 6,240,560 | B1 | * | 6/2001 | DeCaro | 2/67 |
| 6,422,917 | B1 | * | 7/2002 | Rose et al. | 450/65 |
| D484,671 | S | * | 1/2004 | Swan | D2/712 |
| 6,896,582 | B2 | * | 5/2005 | Kawami | 450/86 |

* cited by examiner

*Primary Examiner*—Gary L. Welch
*Assistant Examiner*—Richale L. Haney

(57) ABSTRACT

A bikini assembly includes a bikini top having a first panel and a second panel. A first strap and a second strap are each elongated and each has a first end and a second end. The first strap extends through the first panel. The second strap extends through the second panel. The first and second straps are looped together such that the first panel is attached to the second panel. The first and second straps form arm openings. A bikini bottom includes a third panel having a front edge, a back edge, a first side edge and a second side edge. A third strap is elongated and has a first end and a second end. The third strap extends into the front and back edges so that leg openings are formed between the third strap and each of the first and second side edges.

5 Claims, 4 Drawing Sheets

BIKINI ASSEMBLY

BACKGROUND OF THE INVENTION

1. Field of the Invention

The present invention relates to articles of clothing and more particularly pertains to a new article of clothing for functioning as a bikini.

2. Description of the Prior Art

The use of articles of clothing, and in particular bikinis, is known in the prior art. U.S. Pat. No. 2,443,474 describes a device for covering the bottom torso of a person for swimming and the like. Another type of article of clothing is U.S. Pat. No. 4,031,900 having a pair of pouches connected together for covering breasts and which may be adjusted by the positioning of the straps.

While these devices fulfill their respective, particular objectives and requirements, the need remains for a bikini that is easily adjustable for multiple sizes. This can be accomplished using straps which form a substantial portion of the bikini so that they may be selectively adjusted to accommodate a plurality of body sizes. Additionally, it is preferred that the straps are removable from panels which are used to cover the body. The straps extend through significant portions of panels so that elastic is not required in the stitching of the panels. Repeated washings due to heat and chemicals wear out elastic. By being able to remove the straps from the panels, the bikini will last longer as there will be no elastic to be damaged.

SUMMARY OF THE INVENTION

The present invention meets the needs presented above by utilizing a plurality of straps extending through panels. The straps support the structure of the of the panels and can be adjusted easily for size while also being removable for washing.

To this end, the present invention generally comprises a bikini top having a first panel and a second panel. A first strap is elongated and has a first end and a second end. The first strap extends through the first panel. A second strap is elongated and has a first end and a second end. The second strap extends through the second panel. The first and second straps are looped together such that the first panel is attached to the second panel. The first and second straps form arm openings. A bikini bottom includes a third panel having a front edge, a back edge, a first side edge and a second side edge. A third strap is elongated and has a first end and a second end. The third strap extends into the front and back edges so that leg openings are formed between the third strap and each of the first and second side edges.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
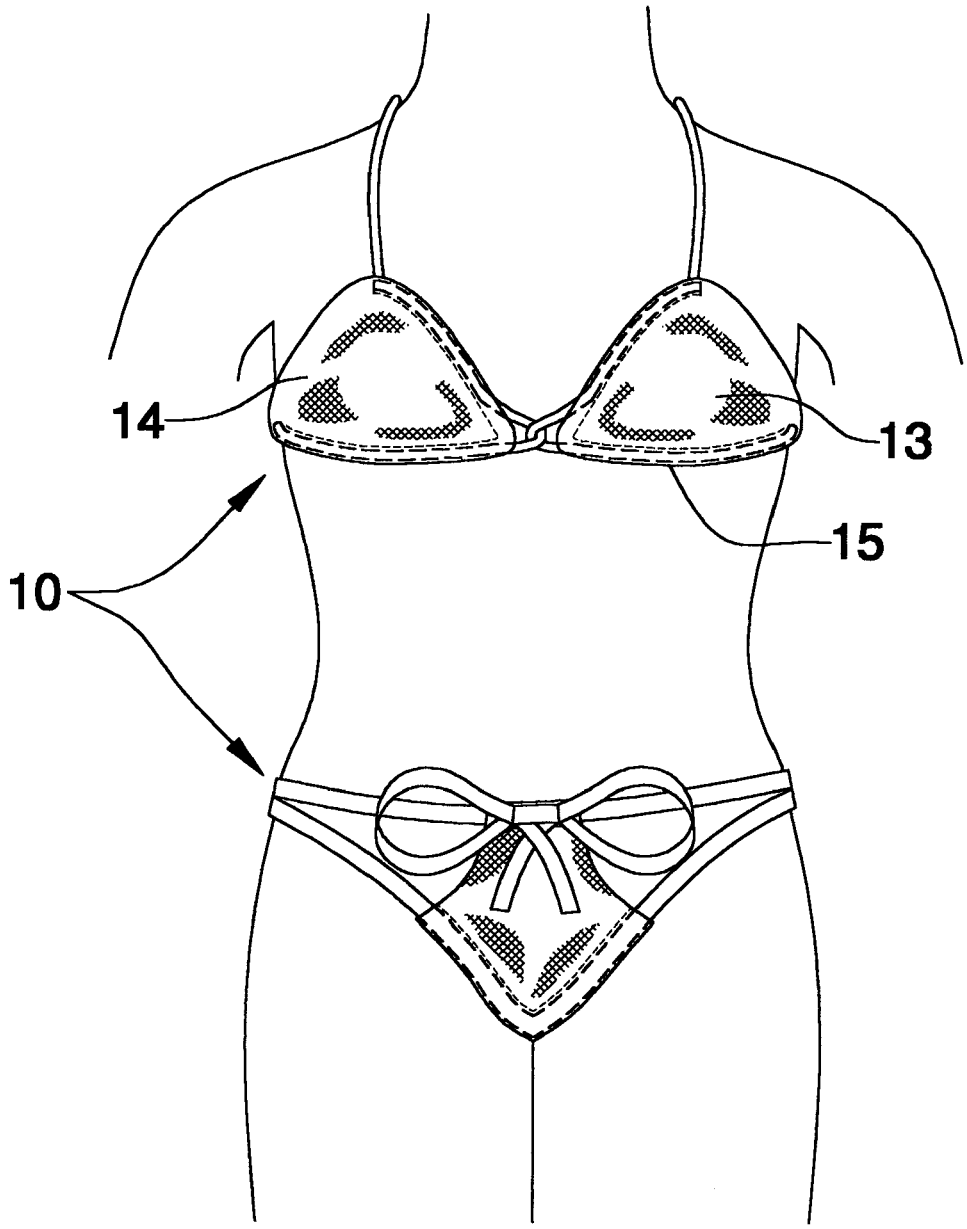
FIG. 1 is a front view of a bikini assembly according to the present invention.
Figure 2:
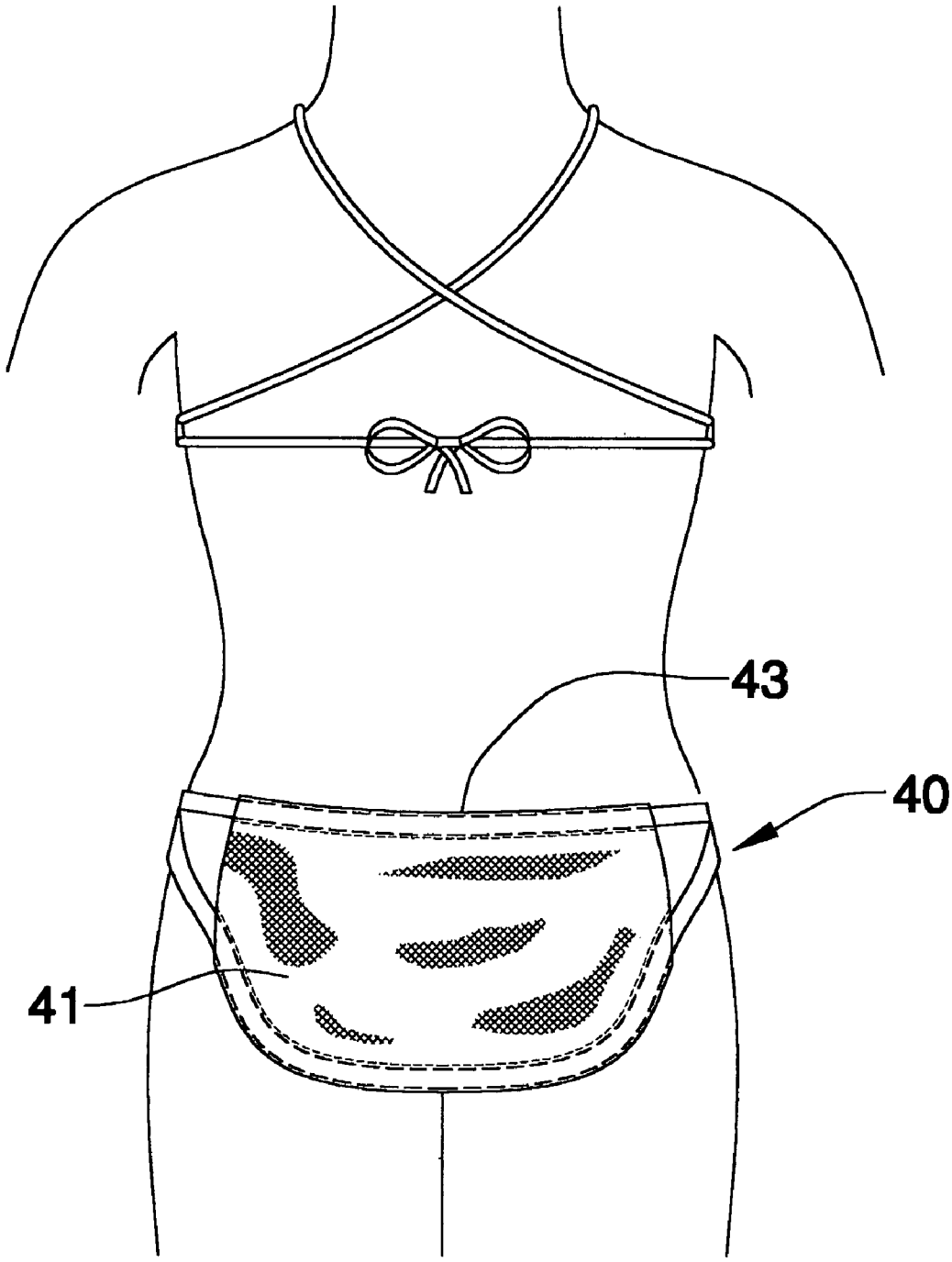
FIG. 2 is a back view of the present invention.

With reference now to the drawings, and in particular to FIGS. 1 through 5 thereof, a new article of clothing embodying the principles and concepts of the present invention and generally designated by the reference numeral 10 will be described.

As best illustrated in FIGS. 1 through 5, the bikini assembly 10 generally includes a bikini top 12 having a first panel 13 and a second panel 14. Each of the first 13 and second 14 panels each have a generally triangular shape adapted for being positioned over and substantially covering a breast. Each of the first 13 and second 14 panels has a peripheral edge 15 that includes an upper edge 16, 17 an inner corner 18, 19 and an outer corner 20, 21. The inner corners 18, 19 are directed toward each other when each of the panels 13, 14 is positioned on a breast.

The bikini top 12 also includes a first strap 24 and a second strap 25 which are each elongated and have a first end 26, 28 and a second end 27, 29. The first end 26 of the first strap 24 extends into the outer corner 20 of the first panel 13 and outwardly of the inner corner 18. The first end 26 of the first strap 24 then extends into the inner corner 18 of the first panel 13 and outwardly of the upper edge 16 such that an inner loop 30 formed by the first strap 24 extends away from the inner corner 18 of the first panel 13. The first end 28 of the second strap 25 extends into the outer corner 21 of the second panel 14 and outwardly of the inner corner 19 and through the inner loop 30. The first end 29 of the second strap 25 extends back into the inner corner 19 of the second panel 14 and outwardly of the upper edge 17. Each of the second ends 27, 29 of the first 24 and second 25 straps comprise a terminal loop. Each of the first ends 24 may be extended through one of the terminal loops, or second ends 27, 29 to form arm receiving openings 31.

A bikini bottom 40 includes a third panel 41 having a front edge 42, a back edge 43, a first side edge 44 and a second side edge 45. Each of the first 44 and second 45 side edges has a concave portion 46, 47 therein positioned between the front 42 and back 43 edges. A front portion 48 is defined between the concave portions 46, 47 and the front edge 42 and a rear portion 49 is defined between the concave portions 46, 47 and the back edge 43.

The bikini bottom 40 also includes a third strap 50 that is elongated and has a first end 51 and a second end 52. The third strap 50 extends into the front edge 42 and outwardly through the first side edge 44 adjacent to the front edge 42. The third strap 50 then extends into the first side edge 44 of the front portion 48 such that a first loop 53 is formed. The third strap 50 extends along the concave portion 46 of the first side edge 44 and outwardly of the first side edge 44 of the rear portion 49. Thereafter the third strap 50 extends through the first loop 46 and into the first side edge 44 adjacent to the rear edge 43. The third strap 50 then extends along the rear edge 43 and outwardly through the second side edge 45 adjacent to the rear edge 43. From this point, the third strap 50 extends into the rear portion 49 of the second side edge 45 and along the concave portion 47 of the second side edge 45 such that a second loop 54 is formed. The third strap 50 extends outwardly of the front portion 48 of the second side edge 45 and through the second loop 54 and then into the second side edge 45 adjacent to the front edge 42. The third strap 50 finally extends outwardly of the front edge 42 such that the first 51 and second 52 ends of the third strap 50 extend away from the front edge 42. Leg openings 55 are formed between the first 53 and second 54 loops and the first 44 and second 45 side edges. It should be understood to those familiar with the art that the bikini bottom 40 may be worn separately from the bikini top 12.

Figure 3:
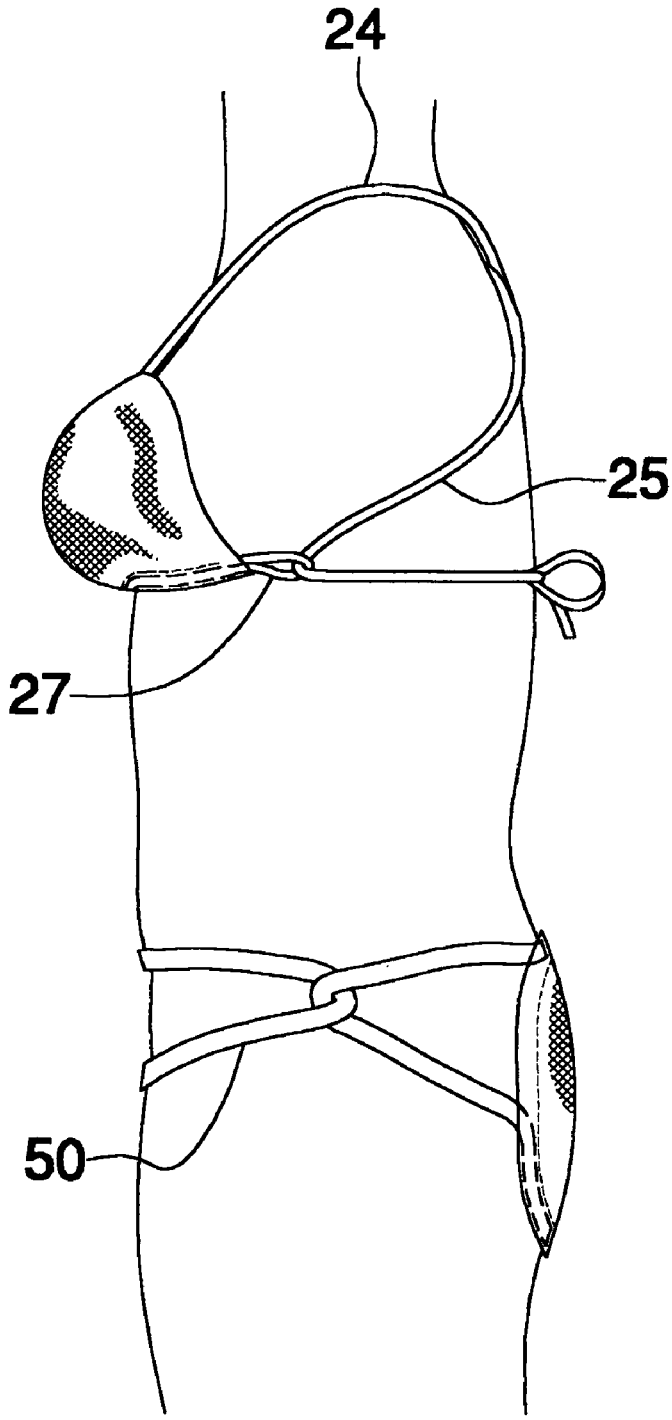
FIG. 3 is a side view of the present invention.
Figure 4:
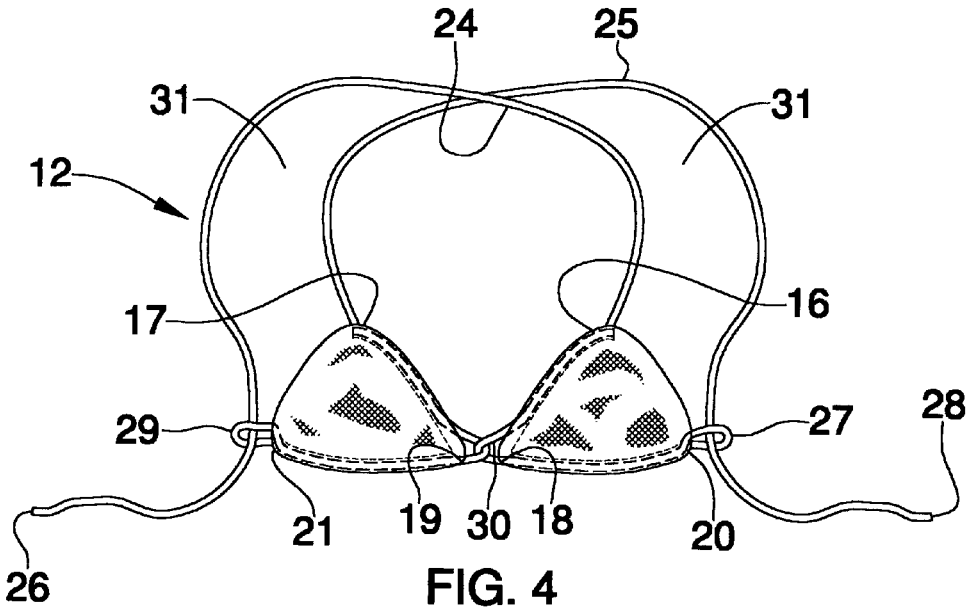
FIG. 4 is a front view of the bikini top of the present invention.
Figure 5:
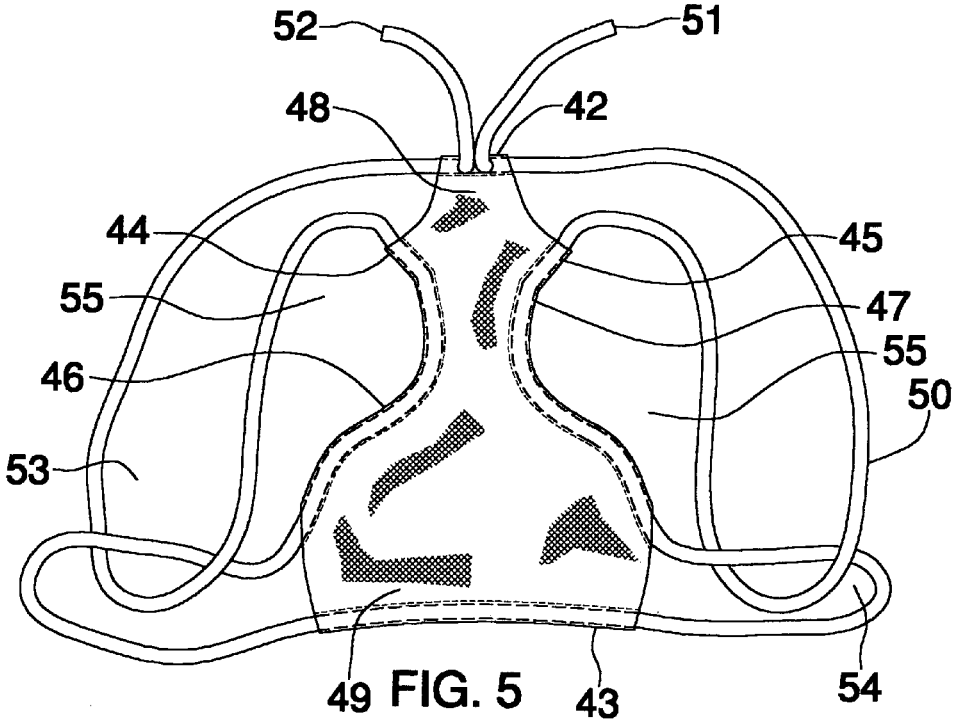
FIG. 5 is a top view of the bikini bottom of the present invention.

In use, the wearer of the bikini extends their head above the first and second panels so that the first 24 and second 25 straps move around the neck. The first 24 and second 25 straps are then extended through the terminal loops 27, 29 as shown in FIGS. 3 and 4 so that the first 27 and second 28 straps extend under the arms. The first ends 26, 28 of the first 24 and second 25 straps are then tied together to hold the bikini top 12 in place. For the bikini bottom 40, the legs are positioned so that each abuts one of the first 44 and second 45 side edges and the adjacently positioned portions of the third strap 50 extend around the outside of the legs. The first 51 and second 52 ends of the third strap 50 are then pulled tight and tied to secure the bikini bottom 40 in place.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. An article of clothing combination comprising:

a bikini top including;

a first panel and a second panel, each of said first and second panels having a generally triangular shape adapted for being positioned over and substantially covering a breast each of said first and second panels having a peripheral edge including an upper edge, an inner corner and an outer corner, said inner corners being directed toward each other when each of said panels is positioned on a breast;

a first strap being elongated and having a first end and a second end, said first strap extending through said first panel, said first end of said of said fit strap extending into said outer corner of said first panel and outwardly of said inner corner, said first end of said first strap extending into said inner corner of said first panel and outwardly of said upper edge such that an inner loop formed by said first strap extends away from said inner corner of said first panel;

a second strap being elongated and having a first end and a second end, said second strap extending through said second panel, said first and second straps being looped together such that said first panel is attached to said second panel, said first and second straps forming arm openings, said first end of said second strap extending into said outer corner of said second panel and outwardly of said inner corner and through said inner loop, said first end of said second strap extending into said inner corner of said second panel and outwardly of said upper edge of said second panel, each of said second ends of said first and second straps comprising a terminal loop, wherein each of said first ends may be extended through one of said terminal loops to form said arm receiving openings;

a bikini bottom including;

a third panel having a front edge, a back edge, a first side edge and a second side edge; and a third strap being elongated and having a first end and a second end, said third strap extending into said front and back edges so that leg openings are formed between said third strap and each of said first and second side edges.

2. The article of claim 1, wherein each of said first and second side edges has a concave portion therein positioned between said front and back edges, a front portion being defined between said concave portions and said front edge and a rear portion being defined between said concave portions and said back edge.

3. The article of claim 2, wherein said third strap extends into said front edge and outwardly through said first side edge adjacent to said front edge, said third strap extending into said first side edge of said front portion such that a first loop is formed, said third strap extending along said concave portion of said first side edge and outwardly of said first side edge of said rear portion, said third strap extending through said first loop and into said first side edge adjacent to said rear edge, said third strap extending along said rear edge and outwardly through said second side edge adjacent to said rear edge, said third strap extending into said rear portion of said second side edge and along said concave portion of said second side edge such that a second loop is formed, said third strap extending outwardly of said front portion of said second side edge and through said second loop, said third strap extending into said second side edge adjacent to said front edge, said third strap extending outwardly of said front edge such that said first and second ends of said third strap extend away from said front edge, wherein said leg openings are positioned between said first and second loops and said first and second side edges.

4. A bikini bottom comprising:

a panel having a front edge, a back edge, a first side edge and a second side edge, each of the first and second side edges has a concave portion therein positioned between the front and back edges, a front portion being defined between the concave portions and the front edge, a rear portion being defined between the concave portions and the back edge;

a strap being elongated and having a first end and a second end, the first end of the strap extends into the front edge and outwardly through the first side edge adjacent to the front edge, the strap then extending into the first side edge of the front portion such that a first loop is formed, the strap then extending along the concave portion of the first side edge and outwardly of the first side edge of the rear portion, the strap then extending through the first loop and into the first side edge adjacent to the rear edge, the strap then extending along the rear edge and outwardly through the second side edge adjacent to the rear edge, the strap then extending into the rear portion of the second side edge and along the concave portion of the second side edge such that a second loop is formed, the strap then extending outwardly of the front portion of the second side edge and through the second loop and then into the second side edge adjacent to the front edge, the strap then extending outwardly of the front edge such that the first and second ends of the strap each extends away from the front edge.

5. An article of clothing combination comprising:

a bikini top including;

a first panel and a second panel;

a first strap being elongated and having a first end and a second end, said first strap extending through said first panel;

a second strap being elongated and having a first end and a second end, said second strap extending through said second panel, said first and second straps being looped together such that said first panel is attached to said second panel, said first and second straps forming arm openings;

a bikini bottom including;

a third panel having a front edge, a back edge, a first side edge and a second side edge, each of said first and second side edges having a concave portion therein positioned between said front and back edges, a front portion being defined between said concave portions and said front edge and a rear portion being defined between said concave portions and said back edge; and a third strap being elongated and having a first end and a second end, said third strap extending into said front and back edges so that leg openings are formed between said third strap and each of said first and second side edges, said third strap extending into said front edge and outwardly through said first side edge adjacent to said front edge, said third strap extending into said first side edge of said front portion such that a first loop is formed, said third strap extending along said concave portion of said first side edge and outwardly of said first side edge of said rear portion, said third strap extending through said first loop and into said first side edge adjacent to said rear edge, said third strap extending along said rear edge and outwardly through said second side edge adjacent to said rear edge, said third strap extending into said rear portion of said second side edge and along said concave portion of said second side edge such that a second loop is formed, said third strap extending outwardly of said front portion of said second side edge and through said second loop, said third strap extending into said second side edge adjacent to said front edge, said third strap extending outwardly of said front edge such that said first and second ends of said third strap extend away from said front edge, wherein said leg openings are positioned between said first and second loops and said first and second side edges.

* * * * *